US006568527B1

(12) United States Patent
Te-Pin

(10) Patent No.: US 6,568,527 B1
(45) Date of Patent: May 27, 2003

(54) BASE BRACKET OF GOLF BAG

(76) Inventor: Cheng Te-Pin, No. 304, Tu-Shin Rd., Taichung City (TW)

( * ) Notice: Subject to any disclaimer, the term of this patent is extended or adjusted under 35 U.S.C. 154(b) by 0 days.

(21) Appl. No.: 10/173,644

(22) Filed: Jun. 19, 2002

(51) Int. Cl.[7] ..... A36B 55/00

(52) U.S. Cl. ..... 206/315.3; 206/315.7; 248/96

(58) Field of Search ..... 206/315.3, 315.7, 206/315.2, 315.8; 248/96; 220/839; 229/189

(56) References Cited

U.S. PATENT DOCUMENTS 5,829,719 A * 11/1998 Han ..... 248/96
5,857,567 A 1/1999 Cheng ..... 206/315.7
6,010,101 A * 1/2000 Stein et al. ..... 248/96
6,062,383 A 5/2000 Han ..... 206/315.7
6,315,117 B1 * 11/2001 Han ..... 206/315.7
6,325,208 B1 * 12/2001 Cheng ..... 206/315.7
6,386,362 B1 * 5/2002 Cheng ..... 206/315.3

* cited by examiner

*Primary Examiner*—Lee Young
*Assistant Examiner*—Lien Ngo
(74) *Attorney, Agent, or Firm*—Troxell Law Office PLLC

(57) ABSTRACT

Base bracket of golf bag, including a front section, a rear section, a first and a second flexible sections formed on the edges of corresponding portions of the open ends of the front and rear sections and a connecting member bridged between the first and second flexible sections. The front and rear sections together form a receiving space with an opening facing upward. The base bracket can be swung about a predetermined portion of the connecting member. When the golf bag stands upright, the lower faces of the front and rear sections are horizontally attached to the ground. By means of the weight of the golf clubs placed in the receiving space, the golf bag can stably stand on the ground. When a user pushes and tilts the golf bag, the rear section is upward stung and the front section keeps contacting with the ground. A supporting leg set pivotally disposed on the golf bag and the front section together support the golf bag to stand in a tilting state.

13 Claims, 3 Drawing Sheets

BASE BRACKET OF GOLF BAG

BACKGROUND OF THE INVENTION

The present invention is related to a component of a golf bag, and more particularly to a base bracket of a golf bag. The base bracket has a receiving space for receiving therein golf clubs. The base bracket is bendable, enabling the golf bag to stably stand in a tilting state. Also, the base bracket is dustproof.

It is known that a user often carries a golf bag on his/her back to walk on a golf course for a long time. Therefore, when design a golf bag, in addition to the capacity, it is necessary to consider easy carriage and good support of the golf bag.

In general, the supporting device of a golf bag permits the golf bag to tilt by an angle when placed on the ground. This prevents the golf bag from falling down and being contaminated by dirt. Also, a user can more conveniently take out the golf club from the tilting golf bag.

U.S. Pat. No. 5,857,567 discloses a golf bag able to stand in a tilting state. A swingable driving plate is disposed under the base bracket of the golf bag. The driving plate serves to drive lower end of a V-shaped spring member so as to indirectly force two lateral supporting legs to stretch outward. Accordingly, the supporting legs can support the golf bag to stand on the ground in a tilting state. The driving plate is hidden under the base bracket so as not to obstruct the user from moving around. The supporting rods of the golf bag are not swingable so that the golf bag can vertically stand more stably.

However, the above golf bag has two major shortcomings as follows:

First, the lower edge of the base bracket must be formed with an oblique matching gap for the movement of the driving plate. When the golf bag stands upright, the base bracket will contact with the ground by too small area so that the golf bag tends to tilt down.

Second, the driving plate is mounted under the base bracket to contact with the ground for a long time. Therefore, the driving plate is easy to be affected by the dirt. As a result, the driving plate can hardly smoothly swing to force the V-shaped spring member to be fully collected on the lateral side of the golf bag. A soft sheet material can be used to enclose the driving plate and the base bracket so as to reduce the above situation. However, the dirt will still infiltrate through the pivot section between the driving plate and the lower edge of the base bracket.

U.S. Pat. No. 6,062,383 discloses a golf bag including a bag body and a base member disposed on lower side of the bag body. The base member is composed of a first plate and a second plate pivotally connected therewith. The first and second plates define a receiving space for the golf clubs. The first plate is pivotable on a pivot section to contain a predetermined angle with the second plate. A predetermined portion of the first plate is provided with a connector. An actuating member is pivotally disposed on the connector, having a set of legs. By means of bending the first plate, the connector is upward rotated to drive the actuating member and the legs. Accordingly, the legs are outward stretched.

Such golf bag has improved dirt insulation effect. However, in order to smoothen the swinging of the first plate, the lateral sides thereof are formed with matching gaps. Dirt and water often get into the bag body through the matching gaps and the pivot section. This affects the reservation of quality of the golf clubs.

SUMMARY OF THE INVENTION

It is therefore a primary object of the present invention to provide a base bracket of a golf bag, which is waterproof and dustproof and easy to clean.

It is a further object of the present invention to provide the above base bracket of the golf bag, which has simple structure and is easy to manufacture at low cost.

According to the above objects, the base bracket of golf bag of the present invention includes a front section, a rear section, a first and a second flexible sections formed on the edges of corresponding portions of the open ends of the front and rear sections and a connecting member bridged between the first and second flexible sections. The front and rear sections together form a receiving space with an opening facing upward. The base bracket can be swung about a predetermined port ion of the connecting member. When the golf bag stands upright, the lower faces of the front and rear sections are horizontally attached to the ground. By means of the weight of the golf clubs placed in the receiving space, the golf bag can stably stand on the ground. When a user pushes and tilts the golf bag, the rear section is upward swung and the front section keeps contacting with the ground. A supporting leg set pivotally disposed on the golf bag and the front section together support the golf bag to stand in a tilting state.

The present invention can be best understood through the following description and accompanying drawings wherein:

DETAILED DESCRIPTION OF THE PREFERRED EMBODIMENTS

Figure 1:
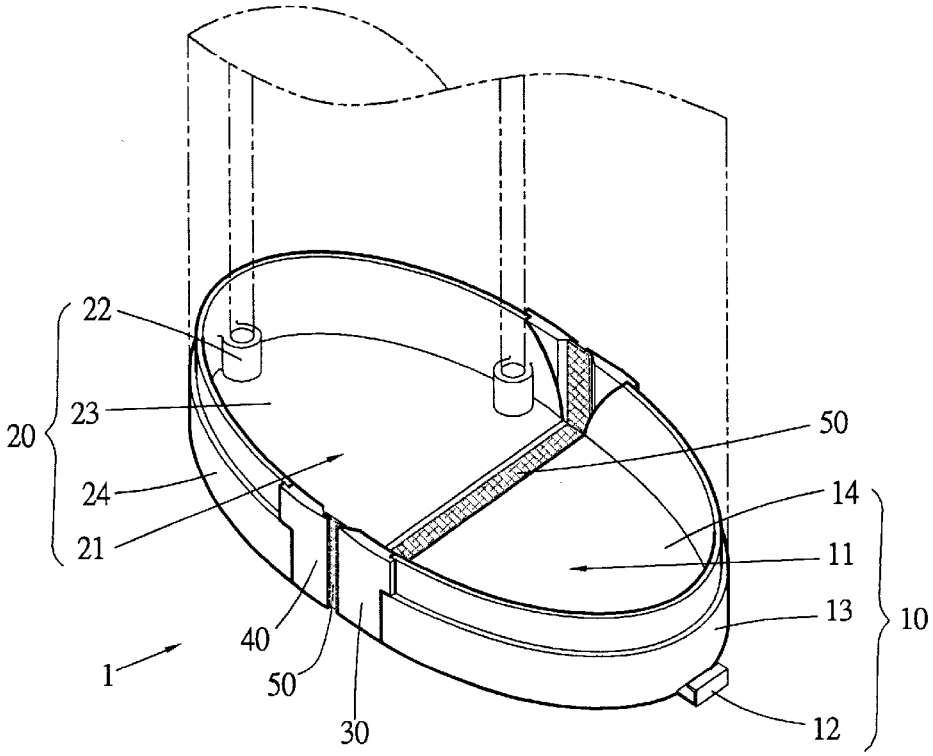
FIG. 1 is a perspective assembled view of the present invention.
Figure 2:
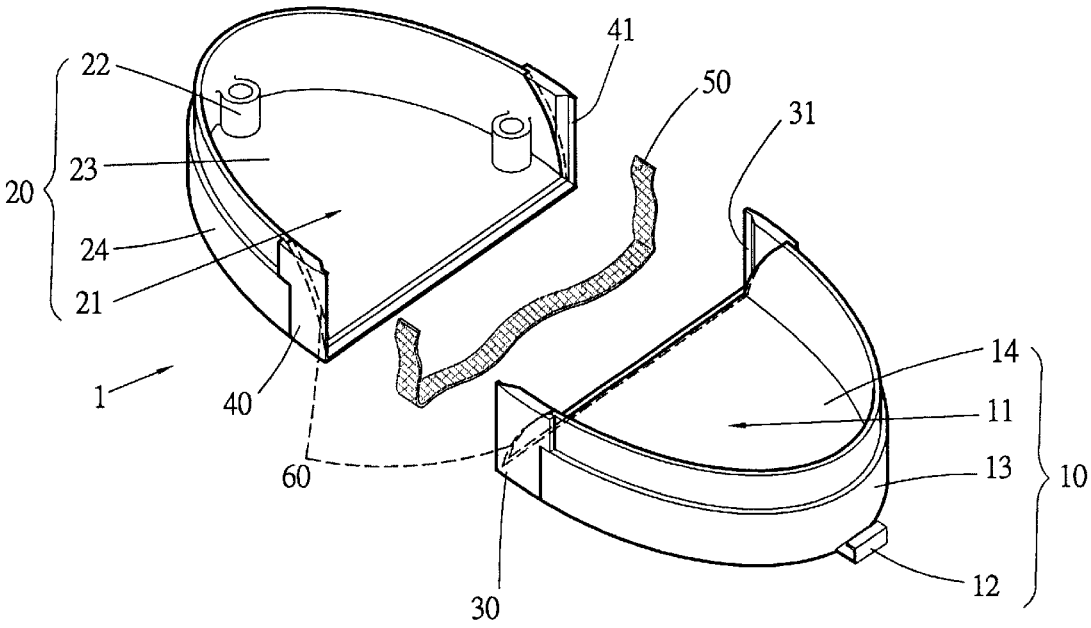
FIG. 2 is a perspective exploded view of the present invention.
Figure 3:
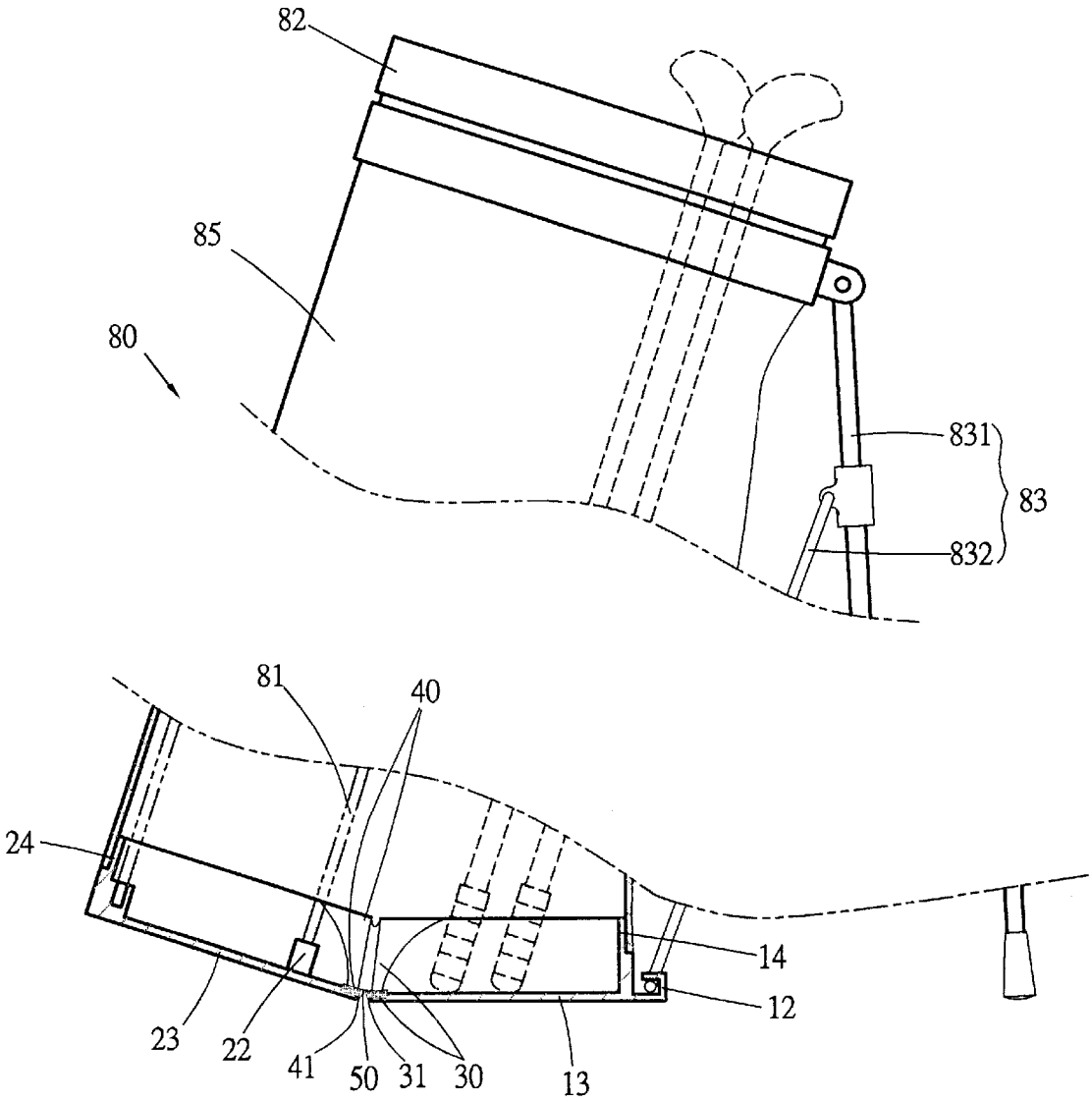
FIG. 3 is a side view showing the use of the present invention.

Please refer to FIGS. 1 to 4. The base bracket 1 of the present invention is disposed on the bottom of a golf bag 8. The golf bag 80 includes three supporting rods 81 fixed on the base bracket 1, a hoop frame 82 disposed at upper end of the supporting rods 81 and a supporting leg set 83 pivotally disposed on outer circumference of the hoop frame 82. The supporting leg set 83 includes a pair of legs 831 and a resilient member 832. A barrel-like flexible bag body 85 is disposed between the base bracket 1 and the hoop frame 82.

The base bracket 1 includes a front section 10, a rear section 20, a first flexible section 30 disposed on the front section 10, a second flexible section 40 disposed on the rear section 20 and a connecting member 50 connected between the first and second flexible sections 30, 40.

The front section 10 has a first base section 13, a first annular wall 14 projecting from the periphery of the first base section 13 and a first receiving space 11 formed between the first base section 13 and the first annular wall 14. The first receiving space 11 has an open end facing upward and an open end facing rearward.

The rear section 20 has a second base section 23, a second annular wall 24 projecting from the periphery of the second base section 23 and a second receiving space 21 formed between the second base section 23,and the second annular wall 24. The second receiving space 21 has an open end facing upward and an open end facing forward.

The first flexible section 30 is made of a material softer than the front section 10. The first flexible section 30 is integrally formed on a predetermined portion of the open end of the front section 10. A part of inner side of the first flexible section 30 is connected with the bottom of the front section 10. Another part thereof is connected with the lateral side of the front section 10. The outer side of the first flexible section 30 extends out from the front section 10 by a predetermined width.

The second flexible section 40 is made of a material softer than the rear section 20. The second flexible section 40 is integrally formed on a predetermined portion of the open end of the rear section 20. A part of inner side of the second flexible section. 40 is connected with the bottom of the rear section 20. Another part thereof is connected with the lateral side of the rear section 20. The outer side of the second flexible section 40 extends out from the rear section 20 by a predetermined width.

A predetermined portion of the outer periphery of the front section 10 is provided with a pivot section 12. The lower end of the resilient member 832 is latched in the pivot section 12.

The connecting member 50 is an elongated strip made of a flexible material softer than the first and second flexible sections 30, 40 (such as unwoven fabric or nylon fabric). The connecting member 50 is disposed between the first and second flexible sections 30, 40 and connected with outer edges of corresponding portions thereof. A part of the connecting member 50 is connected with the first and second flexible sections 30, 40 on the bottom of the base bracket 1, while another part thereof is connected with the first and second flexible sections 30, 40 on the lateral side of the base seat 1. Accordingly, the first front and second rear receiving spaces 11, 21 are connected to together form a larger receiving space. The front and rear sections 10, 20 can swing within a predetermined range about a predetermined portion of the connecting member 50. Also, the outer edges of corresponding portions of the first and second flexible sections 30, 40 are respectively provided with first and second projecting sections 31, 41. The connecting member 50 is bridged and connected between the adjacent first and second projecting sections 31, 41.

A predetermined portion of the rear section 20 is provided with three fixing members 22. The lower end of a supporting rod 81 is inserted in each fixing member 22.

The lateral sides of the open ends of the front and rear sections 10, 20 are convex and spaced from each other by a predetermined distance. A matching gap 60 is formed between the lateral sides and enclosed by the first and second flexible sections 30, 40 and the connecting member 50.

When the golf bag 80 equipped with the base bracket 1 stands upright, the front and rear sections 10, 20 are horizontally placed on the ground. The first and second receiving spaces 11, 21 serve to bear the weight of the golf clubs (not shown) placed in the golf bag 80 so as to stably stand the golf bag 80 on the ground. The supporting rods 81 serve to support the hoop frame 82 to keep the appearance of the bag body 85 tidy.

When a user presses down front end of the golf bag 80 equipped with the base bracket 1 or forward pushes the hoop frame 82, the golf bag 80 is forward tilted. Thereafter, the front section 10 keeps horizontally placed on the ground. The rear section 20 and the supporting rods 81 are upward swung about the bottom of the connecting member 50 to bend the base bracket 1. At this time, a portion of the bag body 85 corresponding to the rear side of the golf bag 80 is still supported by the supporting rods 81 and kept plane. A portion of the bag body 85 corresponding to the front side of the golf bag 80 is slightly crimped. Moreover, the front end of the hoop frame 82 is slightly lowered to minify the distance between the front end and the pivot section 12. Therefore, via the resilient member 832, the two legs 831 are forced to outward stretch. The lower ends of the legs 831 cooperate with the front section 10 to stably stand the golf bag 80 in a tilting state.

Figure 4:
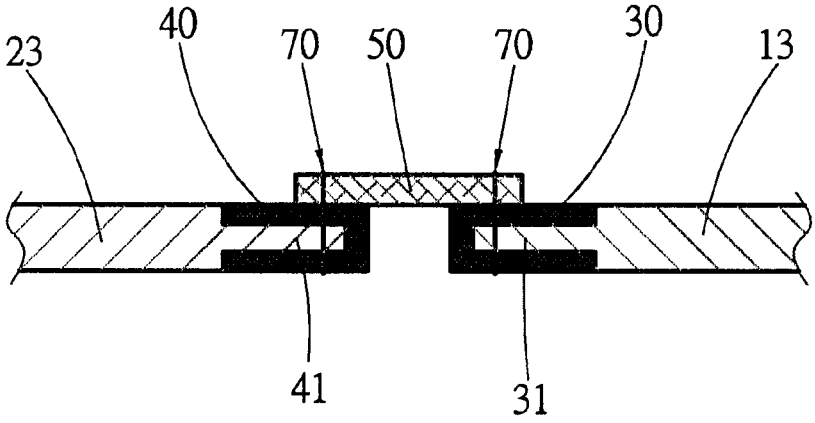
FIG. 4 is a sectional view showing that the connecting member is connected with the flexible sections of the present invention by way of stitching.
Figure 5:
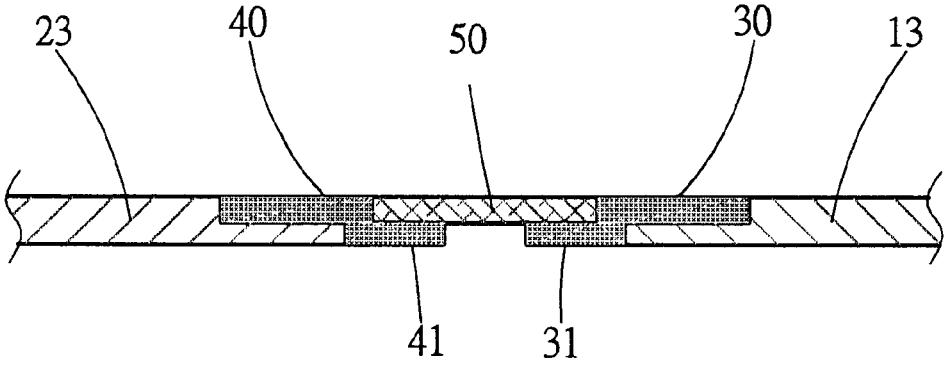
FIG. 5 is a sectional view showing that the connecting member is connected with the flexible sections of the present invention by way of adhesion.

The connecting member 50 is bridged and connected between the first and second flexible sections 30, 40 by way of, stitching. The stitching thread 70 passes through the overlapping front section 10 and first flexible section 30 and the rear section 20 and the second flexible section 40 (as shown in FIG. 4). The first and second flexible sections 30, 40 are flexible so that the stitching thread 70 is tightly bound to prevent dirt and vapor from infiltrating therethrough. Alternatively, the connecting member 50 can be stitched on the adjacent first and second projecting sections 31, 41 of the outer edges of the first and second flexible sections 30, 40 (as shown in FIG. 5). Alternatively, the connecting member 50 can be directly adhered to the first and second flexible sections 30, 40 by an adhesive.

In U.S. Pat. No. 6,386,362 of this applicant, the first and second flexible sections 30, 40 are integrally formed by injection molding without the connecting member 50. Such measure is harder and will leads to increased cost. Moreover, in order to firmly connect the first and second flexible sections 30, 40 with the front and rear sections 10, 20, the material thereof cannot be too soft. Therefore, when bending, the flexibility of the first and second flexible sections 30, 40 is poorer than that of the connecting section 50. A user needs to exert a greater force for tilting the golf bag. In addition, in case of too soft material, the using life will be shortened.

In the above embodiments, the front and rear sections 10, 20 are halves of the base bracket 1 and the connecting member 50 is positioned at the center thereof. However, in practice, the front and rear sections can have different sizes. For example, the capacity of the first receiving space 11 can be smaller than the capacity of the second receiving space 21, whereby the rear section 20 can bear the weight of more golf clubs. Accordingly, the golf bag 80 can stand upright more stably.

The above embodiments are only used to illustrate the present invention, not intended to limit the scope thereof. Many modifications of the above embodiments can be made without departing from the spirit of the present invention.

What is claimed is:

1. Base bracket of golf bag, said base bracket being disposed on a bottom of a bag body of the golf bag under a supporting leg set, the supporting leg set including a pair of legs and a resilient member pivotally connected with the legs, the bag body having multiple supporting rods, said base bracket comprising:

a front section having a firs base section, a first annular wall projecting from the periphery of the first base section and a first receiving space formed between the first base section and the first annular wall, the first receiving space having an open end facing upward and an open end facing rearward;

a rear section having a second base section, a second annular wall projecting from the periphery of the second base section and a second receiving space formed between the second base section and the second annular wall, the second receiving space having an open end facing upward and an open end facing forward;

a first flexible section having a certain elasticity and integrally connected with the first base section and the first annular wall adjacent to the open end of the front section;

a second flexible section having a certain elasticity and integrally connected with the second base section and the second annular wall adjacent to the open end of the rear section; and a connecting member made of a flexible material, two sides of the connecting member being connected between the first and second flexible sections spaced from each other by a predetermined distance, whereby the first front and second rear receiving spaces are connected to together form a larger receiving space and the front and rear sections can swing within a predetermined range about a predetermined portion of the connecting member.

2. Base bracket of golf bag as claimed in claim 1, wherein a predetermined portion of the front section is provided with a pivot section, predetermined portion of the resilient member being pivotally disposed on the pivot section.

3. Base bracket of golf bag as claimed in claim 2, wherein the pivot section protrudes from outer edge of the front section.

4. Base bracket of golf bag as claimed in claim 2, wherein the pivot section protrudes from inner edge of the front section.

5. Base bracket of golf bag as claimed in claim 1, wherein a predetermined portion of the rear section is provided with at least one fixing member, a lower end of a supporting rod being disposed on the fixing member.

6. Base bracket of golf bag as claimed in claim 5, wherein at least one fixing member is disposed in the second receiving space.

7. Base bracket of golf bag as claimed in claim 5, wherein at least one fixing member protrudes from outer edge of the rear section.

8. Base bracket of golf bag as claimed in claim 1, wherein the connecting member is made of unwoven fabric.

9. Base bracket of golf bag as claimed in claim 1, wherein a part of the first and second flexible sections encloses the edges of the first and second base sections and the first and second annular walls adjacent to the open ends of the front and rear sections.

10. Base bracket of golf bag as claimed in claim 1, wherein two sides of the connecting member are fixed on the first and second flexible sections by way of stitching, the connecting member protruding from the open ends of the front and rear sections.

11. Base bracket of golf bag as claimed in claim 1, wherein the connecting member is fixed on the first and second flexible sections by way of stitching, a part of the stitching thread passing through the overlapping portions of the front section and first flexible section, another part of the stitching thread passing through the overlapping portions of the rear section and the second flexible section.

12. Base bracket of golf bag as claimed in claim 1, wherein the capacity of the first receiving space is unequal to the capacity of the second receiving space.

13. Base bracket of golf bag as claimed in claim 1, wherein the lateral sides of the open ends of the front and rear sections are convex and spaced from each other by a predetermined distance, a matching gap being formed between the lateral sides.

* * * * *